US010883443B2

(12) United States Patent
Wicks

(10) Patent No.: US 10,883,443 B2
(45) Date of Patent: Jan. 5, 2021

(54) INTEGRATED CYLINDER HEAD FLUID INJECTION APPARATUS

(71) Applicant: Ford Global Technologies, LLC, Dearborn, MI (US)

(72) Inventor: Christopher Donald Wicks, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 107 days.

(21) Appl. No.: 16/031,791

(22) Filed: Jul. 10, 2018

(65) Prior Publication Data

US 2020/0018254 A1 Jan. 16, 2020

(51) Int. Cl.

| | |
|---|---|
| ***F02F 1/40*** | (2006.01) |
| ***F02F 1/00*** | (2006.01) |
| ***F02B 75/12*** | (2006.01) |
| ***F02F 1/24*** | (2006.01) |

(52) U.S. Cl.

CPC ..... *F02F 1/40* (2013.01); *F02B 2075/125* (2013.01); *F02F 1/242* (2013.01); *F02F 2001/008* (2013.01)

(58) Field of Classification Search

CPC ..... F02F 1/40; F02F 1/242; F02F 2001/008; F02B 2075/125

See application file for complete search history.

(56) References Cited

U.S. PATENT DOCUMENTS

| | | | | |
|---|---|---|---|---|
| 3,490,422 | A | 1/1970 | Bullis | |
| 4,018,192 | A | 4/1977 | Eft | |
| 4,182,278 | A | 1/1980 | Coakwell | |
| 2007/0022977 | A1 | 2/2007 | Crower | |
| 2014/0299105 | A1 | 10/2014 | Hou | |
| 2014/0331970 | A1 | 11/2014 | Bidner et al. | |
| 2016/0097350 | A1 | 4/2016 | Brown | |
| 2016/0230696 | A1 * | 8/2016 | Williams | F02F 1/24 |

FOREIGN PATENT DOCUMENTS

WO WO-2011092364 A1 * 8/2011 ..... F02B 17/005

* cited by examiner

*Primary Examiner* — Jacob M Amick
*Assistant Examiner* — Charles Brauch
(74) *Attorney, Agent, or Firm* — Geoffrey Brumbaugh; McCoy Russell LLP

(57) ABSTRACT

Methods and systems are provided for a fluid injection arrangement integrally formed in a cylinder head. In one example, a method may include molding a polymer composite structure as a single-piece with a fluid injection arrangement arranged integrally therein.

17 Claims, 7 Drawing Sheets

INTEGRATED CYLINDER HEAD FLUID INJECTION APPARATUS

FIELD

The present description relates generally to a fluid injection arrangement integrally formed within a cylinder head.

BACKGROUND/SUMMARY

Cylinder heads may comprise materials such as cast iron and/or aluminum. Metal cylinder heads, such as cast iron, may be heavy and exhibit low thermal conductivity. While aluminum cylinder heads may be lighter, they are more expensive to make than cast iron heads. Additionally, aluminum cylinder heads may exhibit inadequate corrosion resistance and undesired thermal expansion during some conditions. Other types of cylinder heads may include stainless steel, ceramic, ceramic composites, magnesium, and the like. However, these cylinder heads may also experience similar shortcomings.

However, the inventors herein have recognized further potential issues with such systems. As one example, arranging auxiliary components, such as a fluid injection arrangement, into an already formed cylinder head may be cumbersome and expensive. Additionally, fitting of the auxiliary components may present packaging restraints, limiting a size and/or shape of the auxiliary components.

In one example, the issues described above may be addressed by a method molding an external polymer composite structure to at least partially surround an internal metallic structure comprising a fluid injection apparatus integrally formed therein. In this way, a complexity and a manufacturing cost of the cylinder head may decrease relative to previous examples.

As one example, three-dimensionally printing the cylinder head and the fluid injection arrangement may allow integration of more intricate features unfeasible with previous methods of manufacturing. These features may include molding at least a portion of the head with fluid passages shaped for flowing fluid from a fluid injection arrangement to one or more injection nozzles arranged adjacent to one or more cylinders. The injection nozzles may be smaller than nozzles utilized in previous examples due to the three-dimensional printing of the cylinder head and the fluid injection arrangement as a single piece. Smaller injection nozzles may allow introduction of a greater number of injection nozzles, thereby providing greater injection control without affecting combustion conditions due to an injection nozzle size and/or location.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-6 are shown approximately to scale.

DETAILED DESCRIPTION

The following description relates to systems and methods for integrally forming a cylinder head and fluid injection arrangement as a single piece. Forming the cylinder head may further include forming one or more conduits within the cylinder head for fluid to flow from a fluid injection manifold to one or more fluid injection nozzles. The cylinder head may be further shaped to accommodate one or more valves, fuel injector(s), a spark plug, and the like, as shown in FIG. 1.

Figure 2:
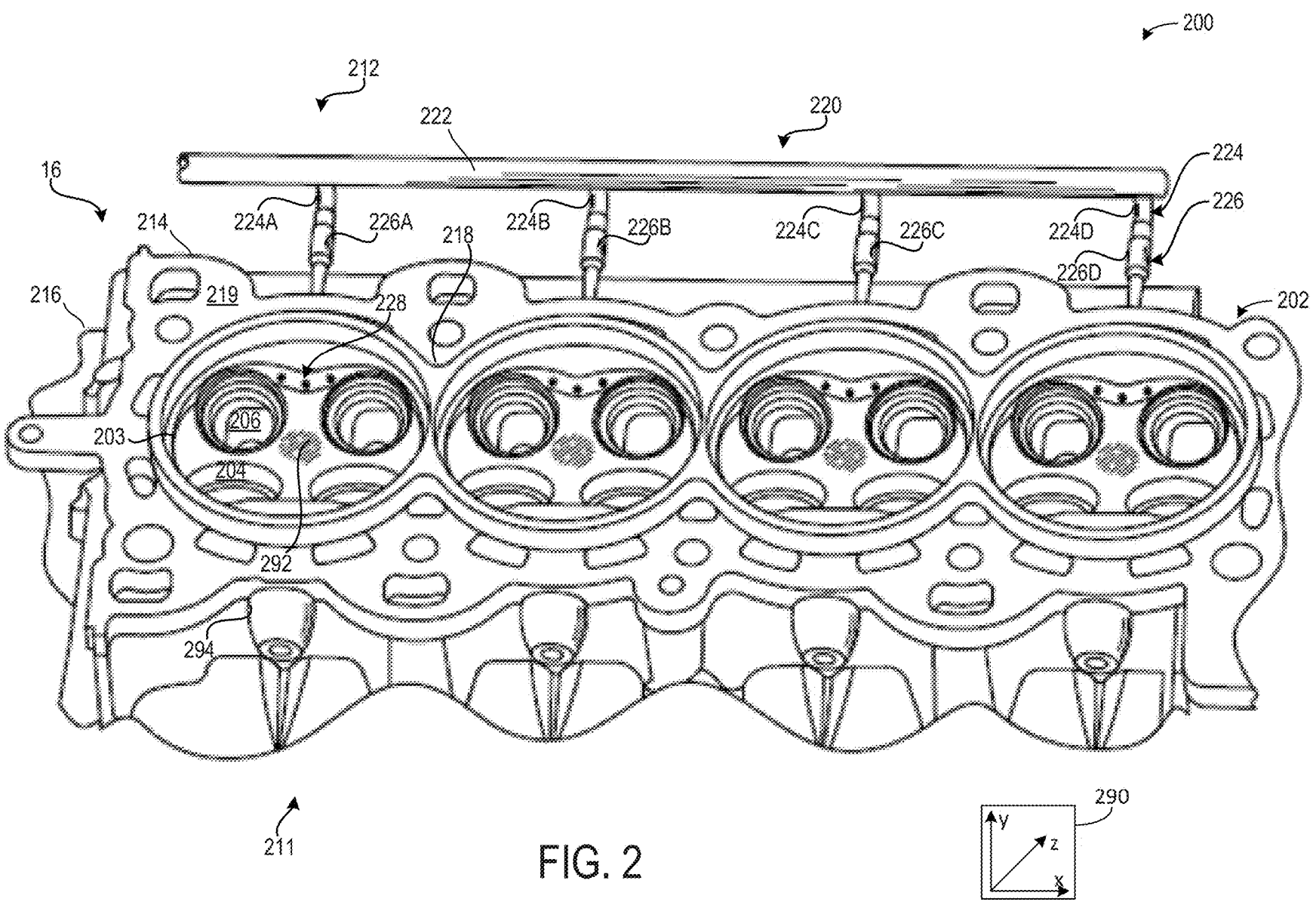
FIG. 2 shows a view of the cylinder head without a valve cover, exposing intake and exhaust ports and the fluid injection arrangement.
Figure 4:
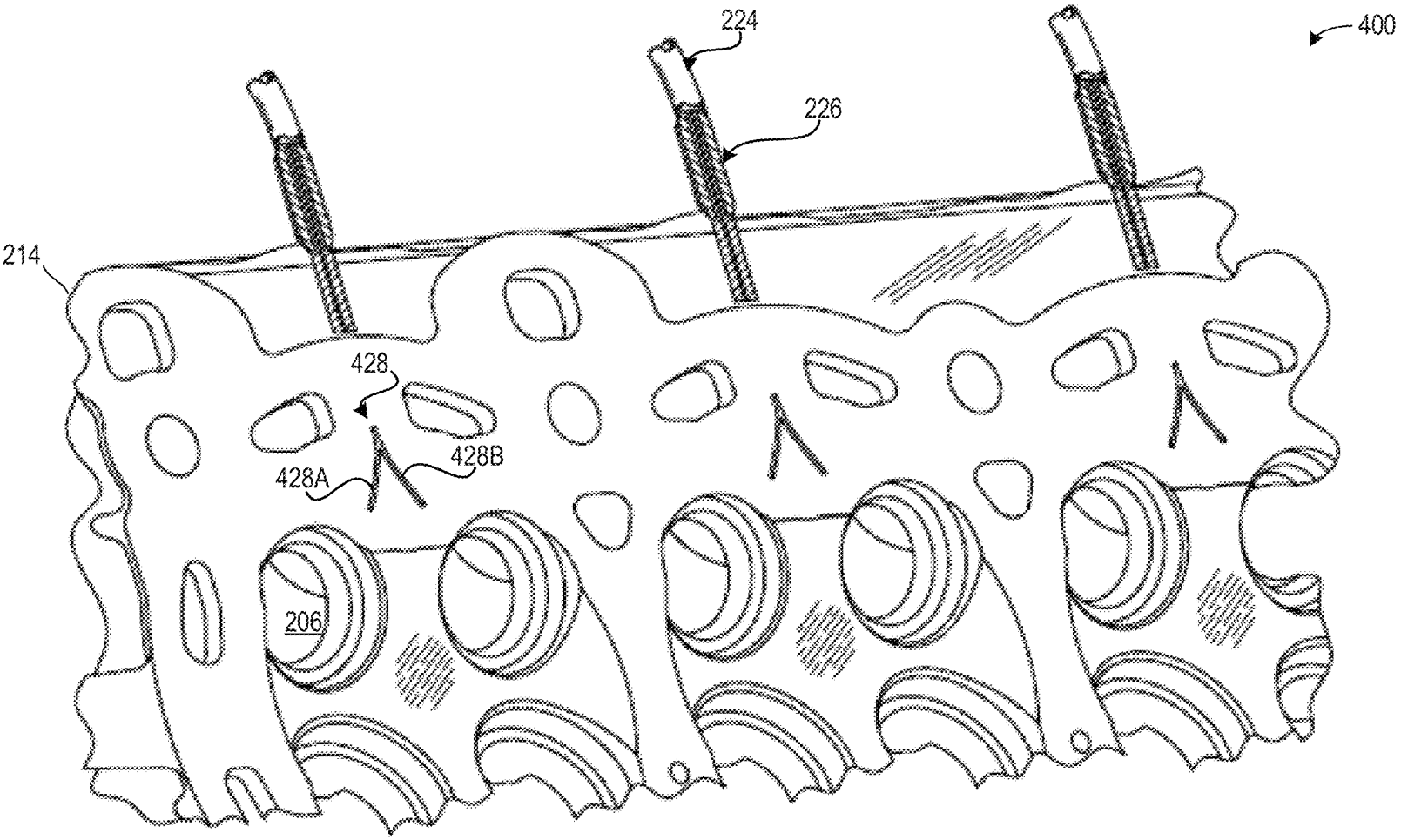
FIG. 4 shows a cross-sectional view of the cylinder head exposing fluid passages extending from the fluid manifold toward the exhaust ports.
Figure 5:
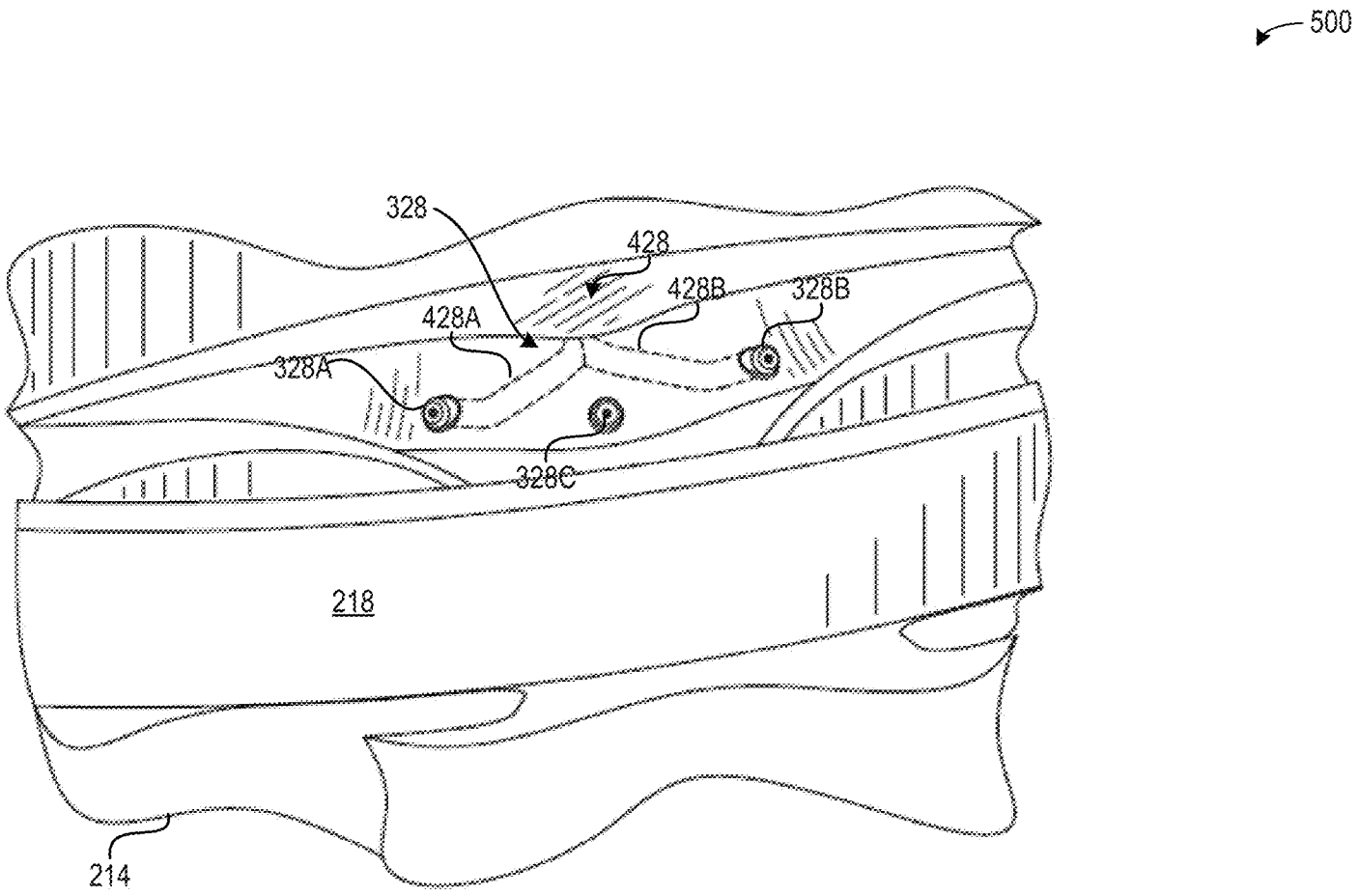
FIG. 5 shows a perspective view of the fluid passages.
Figure 6:
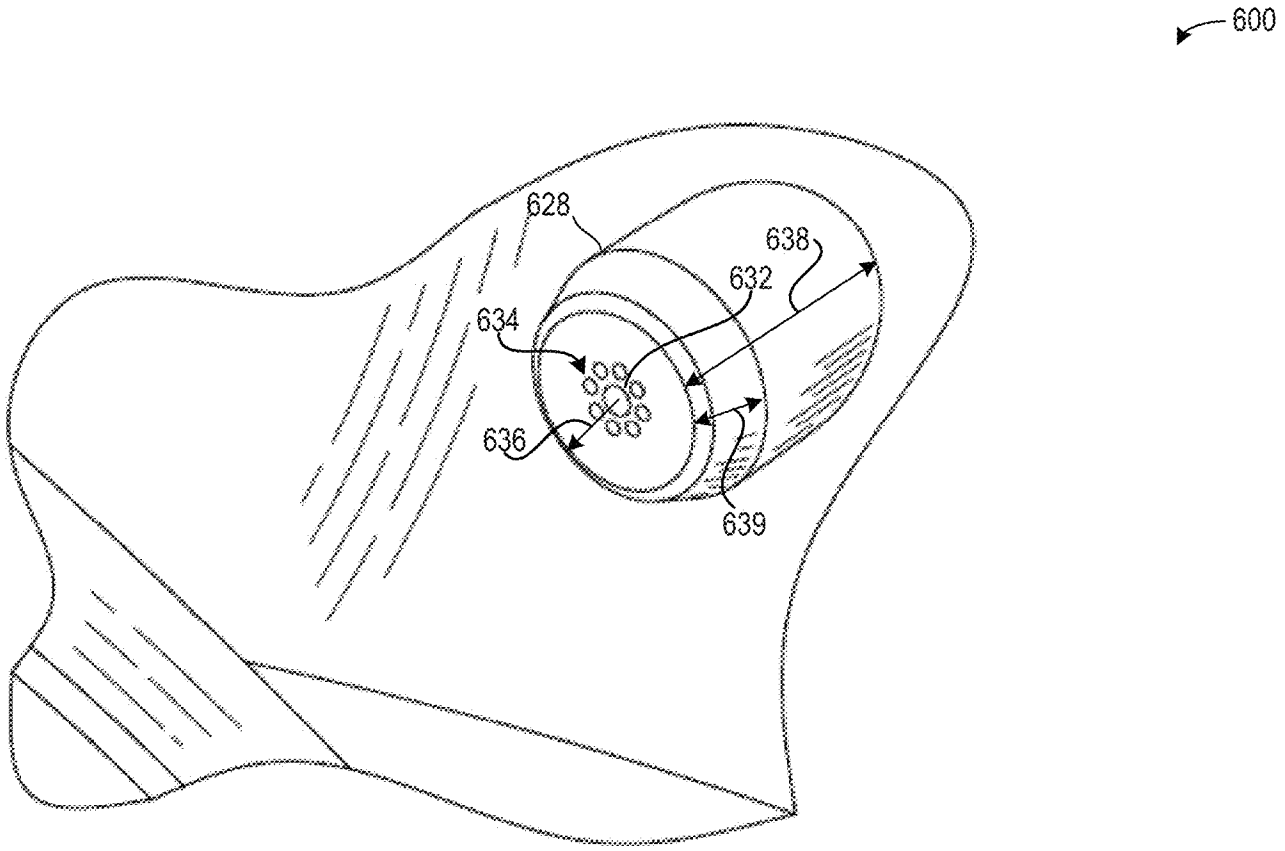
FIG. 6 shows a three-dimensional view of a single fluid injection nozzle.
Figure 7:
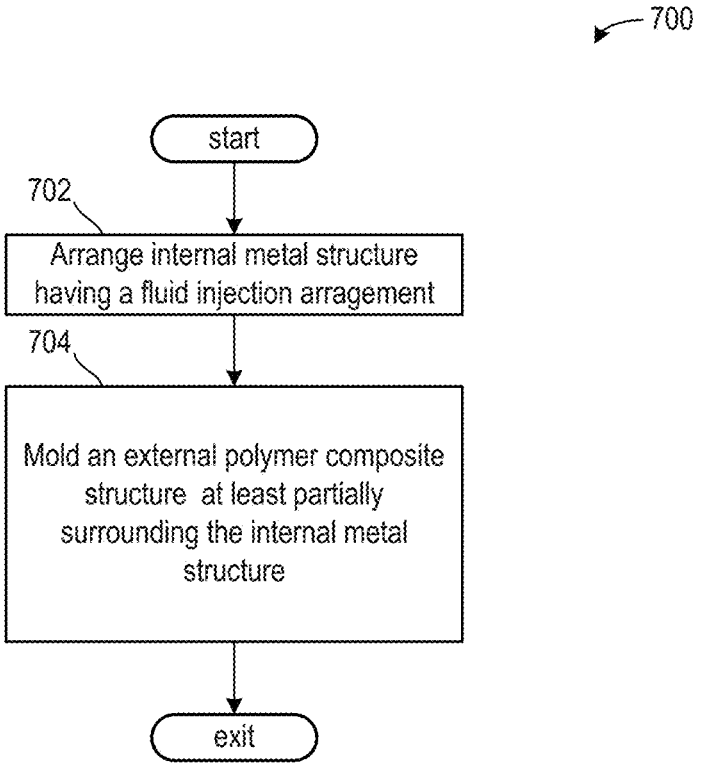
FIG. 7 shows a method for forming a cylinder head having the fluid injection arrangement.

Intake and exhaust ports of the plurality of cylinders are exposed in FIG. 2. A fluid injection arrangement may be integrally formed with the cylinder head such that fluid injection nozzles and fluid passages leading from the fluid injection manifold to the nozzles may be formed as a single-piece with at least a portion of the cylinder head. The fluid injection nozzles are further illustrated in FIG. 3. Fluid passages may be shaped during the printing of the cylinder head, as shown in FIG. 4. Therein, passages are illustrated splitting toward a location of the fluid injection orifices. A perspective view of the fluid injection orifices and fluid injection passages leading thereto is shown in FIG. 5. A close-up view of a fluid injection nozzle of a plurality of fluid injection nozzles is shown in FIG. 6. A method for manufacturing the cylinder head and fluid injection arrangement is shown in FIG. 7.

FIGS. 1-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

Figure 1:
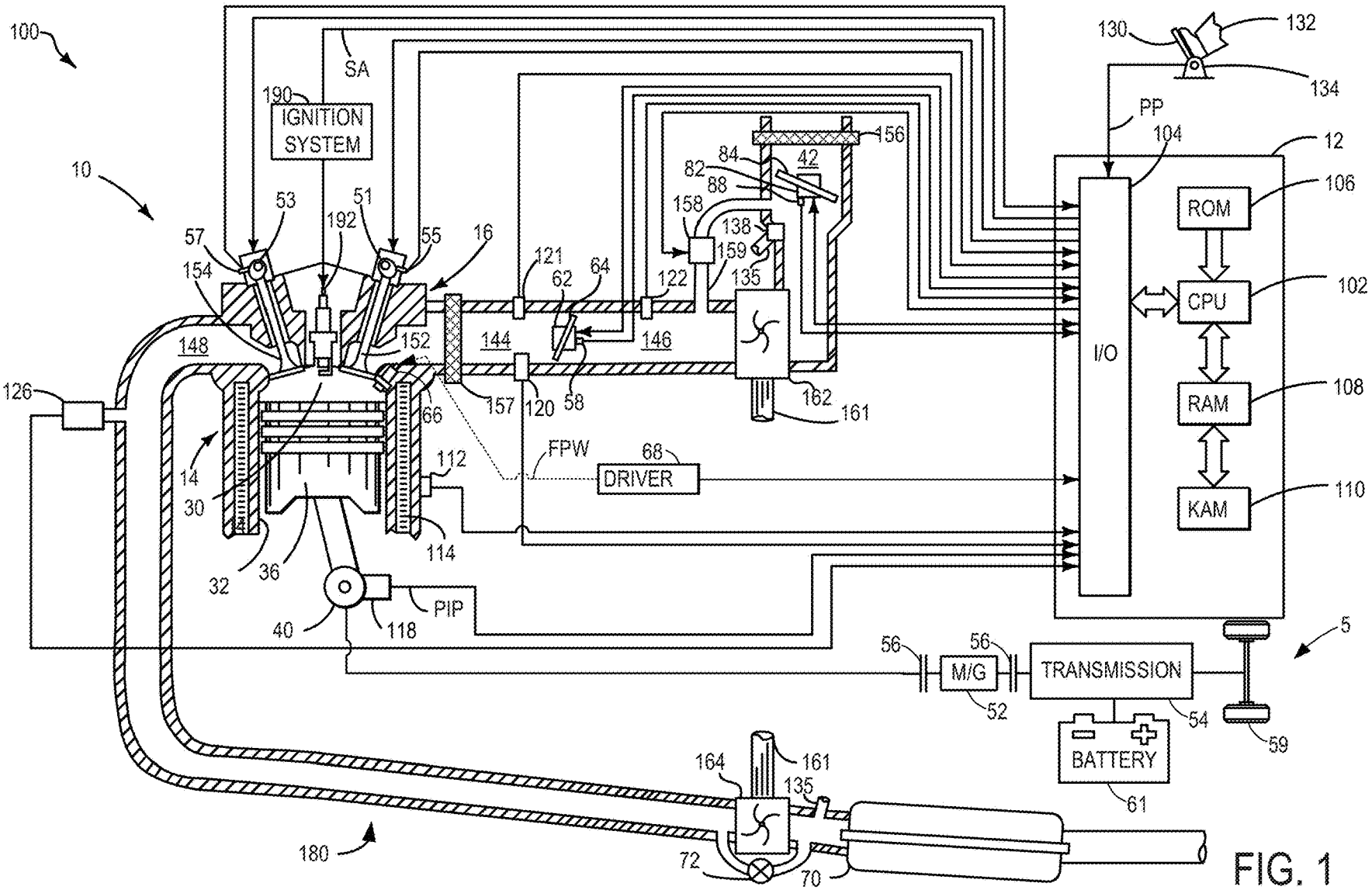
FIG. 1 illustrates a schematic of an engine included in a hybrid vehicle.

FIG. 1 depicts an engine system 100 for a vehicle. The vehicle may be an on-road vehicle having drive wheels which contact a road surface. Engine system 100 includes engine 10 which comprises a plurality of cylinders. FIG. 1 describes one such cylinder or combustion chamber in detail. The various components of engine 10 may be controlled by electronic engine controller 12.

Engine 10 includes a cylinder block 14 including at least one cylinder bore 20, and a cylinder head 16 including intake valves 152 and exhaust valves 154. In other examples, the cylinder head 16 may include one or more intake ports and/or exhaust ports in examples where the engine 10 is configured as a two-stroke engine. The cylinder block 14 includes cylinder walls 32 with piston 36 positioned therein and connected to crankshaft 40. Thus, when coupled together, the cylinder head 16 and cylinder block 14 may form one or more combustion chambers. As such, the combustion chamber 30 volume is adjusted based on an oscillation of the piston 36. Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber 30 and cylinder bore may be fluidly sealed, such that gases may not enter or leave the combustion chamber 30.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. The cylinder head 16 may be coupled to the cylinder block 14 via fasteners, such as bolts and/or screws. In particular, when coupled, the cylinder block 14 and cylinder head 16 may be in sealing contact with one another via a gasket, and as such the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 10.

In some examples, each cylinder of engine 10 may include a spark plug 192 for initiating combustion. Ignition system 190 can provide an ignition spark to cylinder 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

Fuel injector 66 may be positioned to inject fuel directly into combustion chamber 30, which is known to those skilled in the art as direct injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail. Fuel injector 66 is supplied operating current from driver 68 which responds to controller 12. In some examples, the engine 10 may be a gasoline engine, and the fuel tank may include gasoline, which may be injected by injector 66 into the combustion chamber 30. However, in other examples, the engine 10 may be a diesel engine, and the fuel tank may include diesel fuel, which may be injected by injector 66 into the combustion chamber. Further, in such examples where the engine 10 is configured as a diesel engine, the engine 10 may include a glow plug to initiate combustion in the combustion chamber 30.

Intake manifold 144 is shown communicating with throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, AIS throttle 82 may be omitted and airflow to the engine may be controlled with the throttle 62.

In some embodiments, engine 10 is configured to provide exhaust gas recirculation, or EGR. When included, EGR may be provided as high-pressure EGR and/or low-pressure EGR. In examples where the engine 10 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube (not shown in FIG. 1). In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressure can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 1, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from upstream of charge air cooler 157 to the compressor inlet. In alternate examples, compressor recirculation path 159 may be configured to recirculate compressed air from downstream of the compressor and downstream of charge air cooler 157 to the compressor inlet. CRV 158 may be opened and closed via an electric signal from controller 12. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 70. Alternatively, a two-state exhaust gas oxygen sensor may be substituted for UEGO sensor 126. Emission control device 70 may include multiple catalyst bricks, in one example. In another example, multiple emission control devices, each with multiple bricks, can be used. While the depicted example shows UEGO sensor 126 upstream of turbine 164, it will be appreciated that in alternate embodiments, UEGO sensor may be positioned in the exhaust manifold downstream of turbine 164 and upstream of emission control device 70. Additionally or alternatively, the emission control device 70 may comprise a diesel oxidation catalyst (DOC) and/or a diesel cold-start catalyst, a particulate filter, a three-way catalyst, a $NO_x$ trap, selective catalytic reduction device, and combinations thereof. In some examples, a sensor may be arranged upstream or downstream of the emission control device 70, wherein the sensor may be configured to diagnose a condition of the emission control device 70.

Controller 12 is shown in FIG. 1 as a microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

In some examples, vehicle 5 may be a hybrid vehicle with multiple sources of torque available to one or more vehicle wheels 59. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 40 of engine 10 and electric machine 52 are connected via a transmission 54 to vehicle wheels 59 when one or more clutches 56 are engaged. In the depicted example, a first clutch 56 is provided between crankshaft 40 and electric machine 52, and a second clutch 56 is provided between electric machine 52 and transmission 54. Controller 12 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 59. Electric machine 52 may also be operated as a generator to provide electrical power to charge battery 58, for example during a braking operation.

The controller 12 receives signals from the various sensors of FIG. 1 and employs the various actuators of FIG. 1 to adjust engine operation based on the received signals and instructions stored on a memory of the controller. For example, adjusting operation of the electric machine 52 may occur based on feedback from ECT sensor 112. As another example, the controller may receive feedback regarding one or more combustion conditions and actuate one or more valves of a fluid injection arrangement in response to the one or more conditions. The valves and fluid injection arrangement are described in greater detail herein.

Turning now to FIG. 2, it shows an embodiment 200 of the cylinder head 16 of engine 10. As such, components previously introduced may be similarly numbered in subsequent figures. The cylinder head 16 may be at least partially manufactured via 3-D printing of a variety of materials based on one or more desired characteristics such as durability, heat transfer, and packaging constraints. In some examples, the cylinder head 16 may include one or more materials including metallic, carbon fiber, magnesium, titanium, aluminum, cast iron, and ceramic compositions, wherein these materials may be coated with a thermal coating such as a ceramic coating, molybdenum coating or other similar coating.

More specifically, the cylinder head 16 may comprise a first portion 214 and a second portion 216. The first portion 214 may be referred to herein as an internal metal structure 214. The internal metal structure 214 may be a section forming an upper portion of a combustion chamber and/or cylinder head. In some embodiments, additionally or alternatively, the internal metal structure may comprise one or more of valve stem guides, an exhaust face, one or more intake valve spring seats, one or more exhaust valve spring seats, a fire deck, one or more domes of one or more combustion chamber, and one or more bolt columns. The internal metal structure 214 may be made from aluminum, texturized aluminum, cast iron, CGI iron, steel, or another metal. The internal metal structure 214 may comprise one or more alloys. For example, the internal metal structure 214 may comprise an aluminum alloy comprising copper, silicon, manganese, magnesium, the like, or a combination thereof, which may function as a thermal coating. More specifically, the addition of the thermal coating may reduce thermal expansion and contraction, increase durability, and increase castability of the internal metal structure. The internal metal structure 214 may be manufactured as a single piece via casting, monocasting, molding, welding, or by other similar methods.

The second portion 216 may herein be referred to as an external polymer composite structure 216. In some examples, the external polymer composite structure 216 may include one or more of reinforced polymer materials, thermoplastic materials, and thermoset resins. The thermoset resin may include a polyester resin, an epoxy resin, a phenolic resin, a polyurethane, a polyimide, a silicone, or other type of resins, and a combination thereof. The external polymer composite structure 216 may be reinforced with a fibrous material such as fiber reinforced polymers including one or more of carbon fiber, aramid fiber, glass, basalt, and the like. The external polymer composite structure 216 may be formed by arranging the internal metal structure 214 in a dye, wherein the internal metal structure 214 is tempered and the dye is closed. The composite material is supplied to the dye, wherein the external polymer composite structure is shaped by molding during which the composite material cures. The external polymer composite material structure 216 may comprise one or more of a coolant jacket, valve spring pockets, spark plug and direct injection pockets, fuel pump pockets, oil feed(s) to a cam, an intake mounting port, and the like.

In this way, the embodiment 200 may be illustrated from a cylinder block side view. As such, the internal metallic structure 214 may be closer to one or more of a cylinder block, a piston, a ground upon which the vehicle is arranged, and the like than the external polymer composite structure.

A plurality of bore supports 218 may be arranged adjacent to a fire deck 219 of the internal metallic structure 214. The plurality of bore supports 218 may be shaped to aid in alignment of one or more of the combustion chambers, external polymer composite structure 216, and the internal metallic structure 214. The plurality of bore supports 218 may be further configured to function as a cooling bridge backing feature.

An axis system 290 including three axes, namely an x-axis parallel to a horizontal direction, a y-axis parallel to a vertical direction, and a z-axis perpendicular to each of the x- and y-axes is shown. An intake side 211 and an exhaust side 212 of the cylinder head 16 are illustrated.

A cylinder bank 202 is shown comprising a plurality of cylinders 203. In one example, a cylinder of the plurality of cylinders 203 may be used substantially similarly to cylinder 30 of FIG. 1. In some examples, the cylinder bank 202 and the plurality of cylinders 203 are a first cylinder bank and a first plurality of cylinders, wherein a second cylinder bank comprises a second plurality of cylinders, wherein the first and second pluralities of cylinders comprise an equal number of cylinders. In some embodiments, the first and second pluralities of cylinders may comprise four cylinder each and may be arranged in a V-configuration such that engine 10 of FIG. 1 is a V8 engine. However, it will be appreciated that the cylinder banks may be arranged directly opposed to one another in a box configuration. Additionally or alternatively, each of the cylinder banks may comprise a number of cylinders less than or greater than four.

Each cylinder of the cylinder bank 202 may comprise a plurality of intake ports 204 and a plurality of exhaust ports 206. The plurality of intake ports 204 may fluidly couple a combustion chamber to an intake passage. The plurality of exhaust ports 206 may fluidly couple the combustion chamber to an exhaust passage (e.g., exhaust passage 148 of FIG. 1). Intake air flow to the combustion chamber may be metered via one or more of a throttle valve and an intake valve and exhaust gas flow out of the combustion chamber may be metered via an exhaust valve. A spark plug and direct injection area 292 may be arranged along a vertical axis between the intake and exhaust ports 204, 206, directly below spark plug and fuel injection pockets of the external polymer composite structure 216. In some examples, spark plug 192 of FIG. 1 may be vertically aligned with the spark plug and direct injection area 292. A port fuel injection area 294 may correspond to a location of at least one port fuel injector, such as fuel injector 66 of FIG. 1. Additionally or alternatively, a central fuel injector may be arranged adjacent to the spark plug area 292.

As illustrated, the intake and exhaust ports 204, 206 are integrally formed with the internal metallic structure 214. To decrease manufacturing costs, only the exhaust ports 204 may comprise the thermal coating described above. The intake ports 204, due to their lower temperatures relative to the exhaust ports 206, may not be exposed to the same thermal stresses present in the exhaust ports 206, and may be free of the thermal coating.

A fluid injection arrangement 220 may be arranged along the exhaust side 212, including a primary fluid passage 222 may be fluidly coupled to a plurality of secondary fluid passages 224. As shown, the primary fluid passage 222 may be arranged outside of each of the internal metallic structure 214 and the polymer composite structure 216. In some examples, additionally or alternatively, the primary fluid passage 222 may be integrally formed in at least the internal metallic structure 214 without departing from the scope of the present disclosure. In one example, at least a portion of the primary fluid passage 222 is arranged within the internal metallic structure 214 and a remaining portion is arranged outside of the internal metallic structure 214. During the molding of the external polymer composite structure 216, the external polymer composite structure 216 may be optionally molded around at least a portion of the remaining portion of the primary fluid passage 222. In one example, the primary fluid passage 222 is arranged completely outside of each of the internal metallic structure 214 and the external polymer composite structure 216.

The secondary fluid passages 224 may extend from the primary fluid passage 222, through the internal metallic structure 214 and its thermal coating to a location adjacent to exhaust ports 206. Additionally or alternatively, the internal metallic structure 214 may comprise a plurality of internal fluid passages fluidly coupling the secondary fluid passages, as will be described in greater detail with respect to FIG. 4.

In some examples, such as the example shown in FIG. 2, fluid flow from the primary fluid passage 222 through each of the secondary fluid passages 224 may be metered and/or adjusted via one or more valves 226. More specifically, fluid flow from the primary fluid passage 222 to a first secondary fluid passage 224A may be adjusted via a first valve 226A. Fluid flow from the primary fluid passage 222 to a second secondary fluid passage 224B may be adjusted via a second valve 226B. Fluid flow from the primary fluid passage 222 to a third secondary fluid passage 224C may be adjusted via a third valve 226C. Fluid flow from the primary fluid passage 222 to a fourth secondary fluid passage 224D may be adjusted via a fourth valve 226D. The valves 226 may be arranged on portions of the secondary fluid passages 224 outside of the internal metallic structure 214. As shown, each of the primary fluid passage 222 and the secondary fluid passages 224 are formed via tubes.

The first secondary fluid passage 224A may correspond to a first cylinder 202A of the cylinder bank 202 such that first valve 226A adjusts fluid flow to only the first cylinder 202A. The second secondary fluid passage 224B may correspond to a second cylinder 202B such that second valve 226B adjusts fluid flow to only the second cylinder 202B. The third secondary fluid passage 224C may correspond to a third cylinder 202C such that the third valve 226C adjusts fluid flow to only the third cylinder 202C. The fourth secondary fluid passage 224D may correspond to a fourth cylinder 202D such that the fourth valve 226D adjusts fluid flow to only the fourth cylinder 202D. Fluid flow in one of the secondary fluid passages 224 may not mix with fluid flow in different secondary fluid passage 224. For example, fluid in the first secondary fluid passage 224A may not mix with fluid in the second, third, or fourth secondary fluid passages 224B, 224C, and 224D.

Each cylinder of the plurality of cylinders 203 comprises injection ports 228 shaped to inject fluid from the secondary fluid passages 224 toward the exhaust ports 206. In this way, exhaust gas may be mixed with fluid as it flows through exhaust ports 206 toward an exhaust passage (e.g., exhaust passage 148 of FIG. 1) from any of the cylinders of the plurality of cylinders 203. Additionally or alternatively, none or some of the cylinders of the cylinder bank 202 may flow exhaust gas mixed with fluid while all or other cylinders may flow only exhaust gas free of fluid based on a position of one or more of the valves 226.

Each valve of the valves 226 may be adjusted to fully closed and fully open positions. The fully closed position may prevent fluid flow and the fully open position may allow a maximum fluid flow. As an example, if the first valve 226A is in a fully closed position (e.g., 0% open), then fluid from the primary fluid passage 222 may not flow into the first secondary fluid passage 224A. As another example, if the third valve 226C is in a fully open position (e.g., 100% open), then fluid from the primary fluid passage 222 may flow into the third secondary fluid passage 224A at a highest rate (e.g., 100% flow). Additionally or alternatively, the valves 226 may comprise further controls to actuate between the fully closed and fully open positions such that fluid flow may be adjusted to a larger degree. For example, the valves 226 may be adjusted to more open positions or more closed positions, wherein more open positions may permit a greater amount of fluid flow than the more closed positions. In one example, the valves 226 may be actuated to 0%, 100%, or a position therebetween.

The fluid injection arrangement 220 may be shaped to inject one or more fluids, including water, alcohol, gasoline, reductants, catalytic solutions, combustion stabilizers, combinations thereof, and the like. In one example, the fluid injection arrangement 220 injects alcohol. Additionally or alternatively, the fluid injection arrangement 220 injects water. The fluid of the fluid injection arrangement 220 may not mix with other fluids of the engine and/or the vehicle. In one example, the fluid of the fluid injection arrangement 220 may not mix with coolant.

Figure 3:
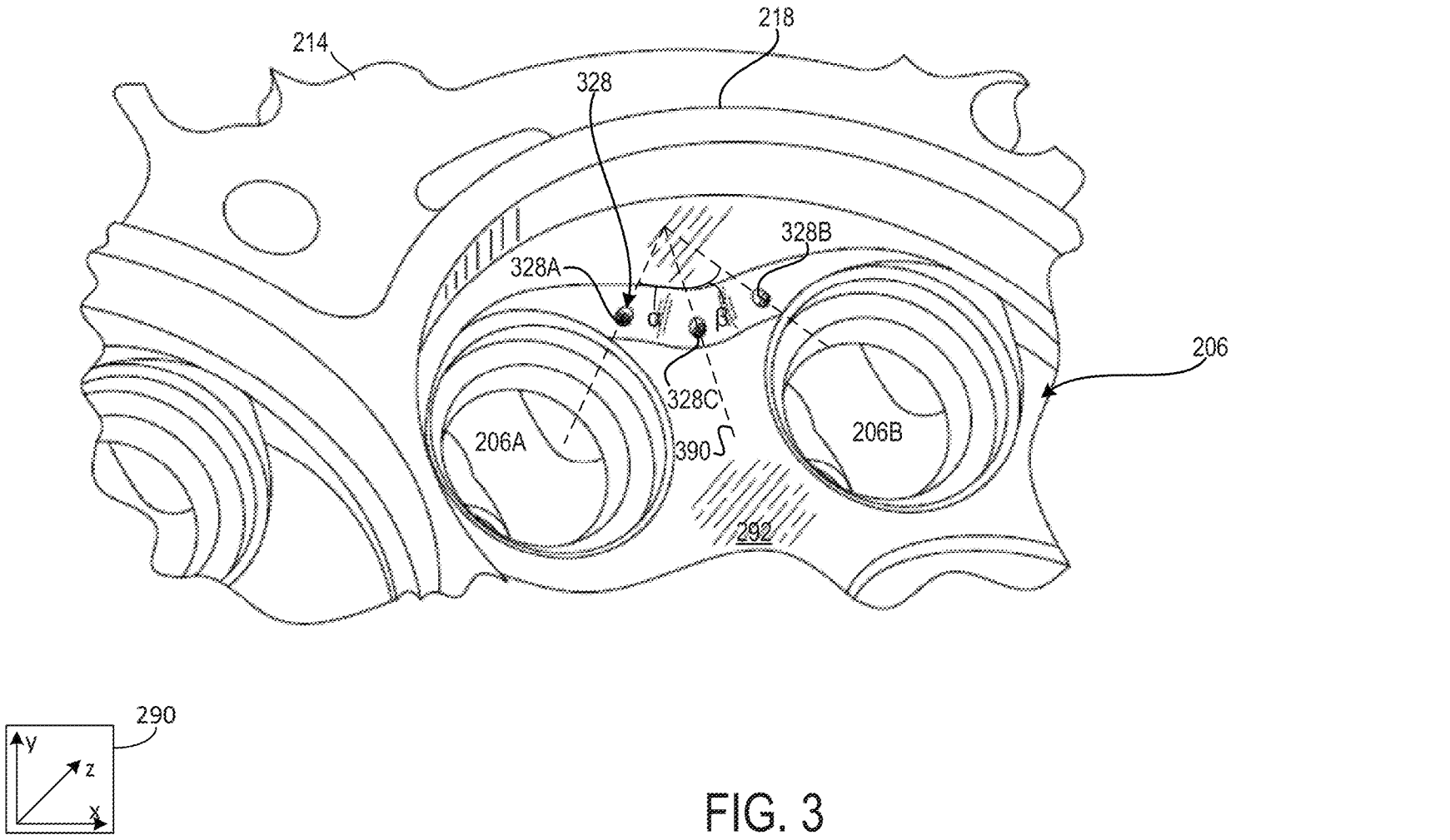
FIG. 3 shows a view of one or more fluid injection nozzles adjacent to one or more exhaust ports.

Turning now to FIG. 3, it shows a close-up view 300 of the exhaust ports 206 and a set of injection ports 328 of the injection ports 228. The exhaust ports 206 may be coupled to a cylinder of the plurality of cylinders 203 of FIG. 2.

The set of injection ports 328 may include at least one injection port. In the example of FIG. 3, there are three injection ports. However, it will be appreciated that less than three or more than three injection ports may be included in the internal metallic structure 214 without departing from the scope of the present disclosure. More specifically, the set of injection ports 328 may include a first injection port 328A, a second injection port 328B, and a third injection port 328C. The first injection port 328A, the second injection port 328B, and the third injection port 328C may be substantially identical in size and shape. However, an orientation of the injection ports 328 may differ.

Each injection port of the set of injection ports 328 may be substantially cylindrical. However, it will be appreciated that the injection ports may comprise other shapes such as cubical, pyramidal, or other similar shapes without departing from the scope of the present disclosure. Each of the first, second, and third injection ports 328A, 328B, and 328C, respectively, may protrude into the combustion chamber by some distance, described in greater detail below with respect to FIG. 6. However, an amount of protrusion (e.g., the distance of protrusion) may be less than other fluid injection arrangements not integrally molded and/or 3-D printed with the internal metallic structure 214. Additionally or alternatively, the injection ports 328 may be flush with a surface of the internal metallic structure 214.

More specifically, the first injection port 328A may be directed at a first angle $\alpha$ and the second injection port 328B may be directed at a second angle $\beta$, each of the first angle $\alpha$ and the second angle $\beta$ measured relative to an injection axis 390 of the third injection port 328C. The first angle $\alpha$ may be substantially equal to the second angle $\beta$. In some examples, the first and second angles $\alpha$, $\beta$ may be acute angles. Additionally or alternatively, the first and second angles $\alpha$, $\beta$ may be between 10 to 80°. Additionally or alternatively, the first and second angles $\alpha$, $\beta$ may be between 15 to 70°. Additionally or alternatively, the first and second angles $\alpha$, $\beta$ may be between 20 to 60°. Additionally or alternatively, the first and second angles $\alpha$, $\beta$ may be between 25 to 50°. Additionally or alternatively, the first and second angles $\alpha$, $\beta$ may be between 30 to 45°. In one example, the first and second angles $\alpha$, $\beta$ are equal to exactly 40°. Additionally or alternatively, the first and second angles α, β may be different than one another.

The first injection port 328A may be arranged adjacent to a first exhaust port 206A. The first injection port 328A may be further oriented to inject a fluid into the combustion chamber at an area adjacent to the first exhaust port 206A. The second injection port 328B may be arranged adjacent to a second exhaust port 206B. The second injection port 328B may be further oriented to inject fluid into the combustion chamber at an area adjacent to the second exhaust port 206B while the first injection port 328A. By being oriented to inject fluid near one of the exhaust ports 206, exhaust gas flowing through the exhaust ports may readily sweep the fluid injection through the exhaust ports with minimal penetration of the fluid injection into the cylinder.

Additionally or alternatively, the fluid injection timing may be adjusted based on an exhaust valve timing to adjust an amount of penetration of the injection. For example, the fluid injection timing may be adjusted to more closely resemble the exhaust valve timing to decrease penetration into the combustion chamber.

The third injection port 328C may be arranged between the first and second injection ports 328A, 328B. The third injection port 328C may be further oriented to inject a fluid into the combustion chamber at an area adjacent the spark plug area 292. A general injection direction of the third injection port 328C may be along the injection axis 390.

In some examples, each of the first, second, and third injection ports 328A, 328B, and 328C may inject a fluid in one or more of a cone shape, cylinder shape, star shape, or other shape. In some examples, each of the first, second, and third injection ports 328A, 328B, and 328C may inject in a different shape. For example, the first injection port 328A may inject in a cylinder shape and the third injection port 328C may inject in a cone shape.

Turning now to FIG. 4, it shows a cross-section 400 of the cylinder head 16 exposing internal fluid passages 428. More specifically, the cross-section 400 reveals a first internal fluid passage 428A and a second internal fluid passage 428B. Each of the internal fluid passages 428 may split from the secondary fluid passages 224. That is to say, the secondary fluid passages 224 may be fluidly coupled to the internal fluid passages 428. The internal fluid passages 428 may be formed via internal surfaces of the internal metallic structure 214 and may be free of the tubes forming the primary and secondary fluid passages. In some examples, valves 226 may only adjust fluid flow into the secondary fluid passages 224. In one example, valves 226 may not adjust fluid flow to individual fluid passages of the internal fluid passages 428. In this way, fluid in the secondary fluid passages 224 may flow to each corresponding internal fluid passages 428 when a corresponding valve of the vales 226 is open.

In some embodiments, a number of internal fluid passages 428 branching from the secondary fluid passages 224 may be equal to a number of injection ports positioned to inject into the combustion chamber. In the example of FIG. 4, there are three injection ports positioned to inject into the combustion chamber, wherein the cross-section 400 exposes two of the three internal fluid passages, the first internal fluid passage 428A and the second internal fluid passage 428B. In one example, the first internal fluid passage 428A may be shaped to flow fluid to the first injection port 328A and the second internal fluid passage 428B may be shaped to flow fluid to the second injection port 328B of FIG. 3. As such, a third internal fluid passage, which may be occluded in the cross-section 400 by surfaces of the internal metallic structure 214 may be shaped to flow fluid to the third injection port 328C of FIG. 3.

The internal fluid passages 428 may be integrally formed within the internal metallic structure 214 as a single-piece. In one example, the internal fluid passages 428 are not drilled, bored, or carved into the internal metallic structure 214. Said another way, the internal fluid passages 428 may be formed as the internal metallic structure 214 is formed.

Turning now to FIG. 5, it shows a perspective view 500 of the first and second internal fluid passages 428A, 428B and the set of injection ports 328. As shown, the first internal fluid passage 428A is directly coupled to the first injection port 328A and the second internal fluid passage 428B is directly coupled to the second injection port 328B. Fluid in the first internal fluid passage 428A may not mix with fluid in the second internal fluid passage 428B. In one example, fluid in one of the internal fluid passages does not mix with fluid in the other internal fluid passages.

The perspective view 500 further illustrates a division of the secondary fluid passage (e.g., secondary fluid passage 224), the division generating the internal fluid passages 428 shaped to deliver fluid to the injection ports. In one example, the secondary fluid passage may be fluidly coupled to an internal passage of the internal metallic structure 214, wherein the internal passage trifurcates to flow fluid to each of the injection ports 328.

Turning now to FIG. 6, it shows a detailed view 600 of a single injection port 628 of the plurality of injection ports (e.g., injection ports 228 of FIG. 2). The single injection port 628 may be arranged along and extend from the internal metallic structure (e.g., internal metallic structure 214 of FIG. 2) into the combustion chamber. The single injection port 628 may be formed integrally with the internal metallic structure. In one example, the single injection port 628, and the other injection ports (e.g., injection ports 228), are 3-D printed with the internal metallic structure.

The single injection port 628 may protrude into the combustion chamber as described above, wherein a protrusion amount may correspond to a length 638 of the single injection port 628. Length 638 of the single injection port 628 may be substantially equal to lengths of other injection ports (e.g., injection ports 228 of FIG. 2). Length 638 may be between 0.5 and 5.0 mm. In some examples, additionally or alternatively, length 638 may be between 1.0 and 3.0 mm. In some examples, additionally or alternatively, length 638 may be between 1.0 and 2.0 mm. In some examples, additionally or alternatively, length 638 may be between 1.25 and 1.75 mm. In one example, length 638 is equal to 1.6 mm.

In some examples, additionally or alternatively, the single injection port 628 may be flush with surfaces of the internal metallic structure 214 such that the single injection port 628 does not affect a volume of the combustion chamber. In some examples, additionally or alternatively, a protrusion amount of the injection ports may vary such that some injection ports protrude some distance into the combustion chamber and other injection ports are flush with surfaces of the internal metallic surface 214.

The single injection port 628, along with other injection ports, such as injection ports 228 of FIG. 2, may be similarly shaped, wherein the shape may be cylindrical. A radius 636 of the single injection port 628 may be equal to radii of other injection ports (e.g., injection ports 228 of FIG. 2). The radius 636 may be between 0.1 to 5 mm. In some examples, additionally or alternatively, the radius 636 may be between 0.5 and 2 mm. In some examples, additionally or alternatively, the radius 636 may be between 0.8 and 1.5 mm. In one example, the radius 636 is equal to 1.0 mm.

In some examples, such as the example of FIG. 6, the body of the single injection port 628 may deviate from a cylindrical-shape. More specifically, in the example of FIG. 6, the body of the single injection port 628 narrows toward an end of the body near one or more injection orifices and/or openings. A length 639 of the narrowing may be between 0.01 to 1.0 mm. In some examples, additionally or alternatively, the length 639 may be between 0.1 to 0.8 mm. In some examples, additionally or alternatively, the length 639 may be between 0.3 to 0.6 mm. In one example, the length 639 is 0.4 mm.

The single injection port 628 comprises a plurality of openings 630 including a primary opening 632 and a plurality of peripheral openings 634. The primary opening 632 may be surrounded by the plurality of peripheral openings 634. The primary opening 632 may be shaped similarly to each of the plurality of peripheral openings 634. A shape of the primary opening 632 and the plurality of peripheral openings 634 may be triangular, circular, square, rectangular, diamond, trapezoidal, polyhedral, or some other similar shape. Herein, the primary opening 632 and the plurality of peripheral openings 634 are circular.

The primary opening 632 may comprise a first diameter and each of the peripheral openings 634 may be equally sized and comprise a second diameter. The first diameter may be larger than the second diameter such that the primary opening 632 may inject more fluid than a single peripheral opening of the peripheral openings 634. However, a total volume of fluid injected from all of the peripheral openings 634 may be greater than a volume of fluid injected from the primary opening 632.

The first diameter of the first opening 632 may be between 0.01 and 1.0 mm. In some examples, additionally or alternatively, the first diameter of the first opening 632 may be between 0.05 and 0.5 mm. In some examples, additionally or alternatively, the first diameter of the first opening 632 may be between 0.1 and 0.3 mm. In some examples, additionally or alternatively, the first diameter of the first opening 632 may be between 0.15 and 0.25 mm. In one example, the first diameter of the first opening 632 is equal to 0.2 mm.

The second diameter of the peripheral openings 634 may be between 0.001 and 0.5 mm. In some examples, additionally or alternatively, the second diameter of the peripheral openings 634 may be between 0.01 and 0.25 mm. In some examples, additionally or alternatively, the second diameter of the peripheral openings 634 may be between 0.05 and 0.1 mm. In some examples, additionally or alternatively, the second diameter of the peripheral openings 634 may be between 0.08 and 0.1 mm. In one example, the second diameter of the peripheral openings 634 is equal to 0.09 mm.

Turning now to FIG. 7, it shows a method 700 for arranging the cylinder head comprising the fluid injection arrangement illustrated through FIGS. 1-6. The method 700 begins at 702 which includes arranging an internal metal structure having a fluid injection arrangement arranged at least partially therein. The internal metal structure may be a section forming an upper portion of a combustion chamber. The internal metal structure may be manufactured as a single piece via casting, monocasting, molding, welding, 3-D printing or by other similar methods.

The method 700 may proceed to 704, which may include molding an external polymer composite structure at least partially surrounding the internal metal structure. The polymer composite structure may be formed by arranging the internal metal structure in a dye, wherein the internal metal structure is tempered and the dye is closed. The composite material is supplied to the dye, wherein the polymer composite structure is shaped by molding during which the composite material cures. The molding may further comprising where the external polymer composite structure does not obstruct or cover various portions of the fluid injection arrangement integrally formed within the internal metallic structure such that the secondary fluid passages may fluidly couple to the internal fluid passages. The polymer composite material structure may comprise one or more of a coolant jacket, valve spring pockets, spark plug and direct injection pockets, fuel pump pockets, oil feed(s) to a cam, an intake mounting port, the fluid injection arrangement, and the like. The coolant jacket may be completely fluidly separated from the fluid injection arrangement of the internal metallic structure. In one example, fluids in the fluid injection arrangement do not mix with fluids in the coolant jacket or other portions of the coolant system. Thus, the internal metallic structure and the external polymer composite structure may be shaped to accommodate multiple fluid sources and/or passages without allowing mixing therebetween.

In this way, a cylinder head may be manufactured to decrease manufacturing costs and decrease packaging constraints by at least partially surrounding an internal metallic structure with an external polymer composite structure. Furthermore, the internal metallic structure may be integrally formed with a fluid injection arrangement to further decrease manufacturing costs and packaging constraints while providing a direct injection arrangement in the combustion chamber. The technical effect of integrating the fluid injection arrangement with the internal metallic structure is to provide complex features within the combustion chamber while decreasing manufacturing time and costs.

An example of a method comprising molding an external polymer composite structure to at least partially surround an internal metallic structure comprising a fluid injection arrangement integrally formed therein. A first example of the method further includes where the internal metallic structure further comprises shaping one or more internal fluid passages fluidly coupling a primary water passage to a plurality of injection ports. A second example of the method, optionally including the first example, further includes where the injection ports are arranged adjacent to one or more exhaust ports within a combustion chamber. A third example of the method, optionally including the first and/or second examples further includes where the internal fluid passages are separated from coolant and oil passages formed in the external polymer composite structure, and where fluid in the internal fluid passages does not mix with fluids from the coolant and oil passages. A fourth example of the method, optionally including one or more of the first through third examples, further includes where the internal metallic structure is an upper portion of the combustion chamber, and where the internal metallic structure comprises a fire deck.

A system comprising an engine comprising an internal metallic structure arranged on a combustion chamber side of an external polymer composite structure, wherein the external polymer composite structure is molded as a single-piece onto and at least partially surrounding the internal metallic structure, and where the internal metallic structure comprises a fluid injection arrangement integrally formed therein. A first example of the system further includes where the fluid injection arrangement comprising a primary fluid passage and a plurality of valves arranged outside of the internal metallic structure. A second example of the system, optionally including the first example, further includes where a plurality of secondary fluid passages extends from the primary fluid passage and fluidly couples to a plurality of internal fluid passages integrally formed in the internal metallic structure. A third example of the system, optionally including the first and/or second examples further includes where a number of the plurality of secondary fluid passages is equal to a number of the plurality of valves. A fourth example of the system, optionally including one or more of the first through third examples, further includes where the plurality of internal fluid passages divides within the internal metallic structure to flow fluid to a plurality of injection ports. A fifth example of the system, optionally including one or more of the first through fourth examples, further includes where the fluid injection arrangement is arranged on an exhaust side of the internal metallic structure. A sixth example of the system, optionally including one or more of the first through fifth examples, further includes where the fluid injection arrangement is shaped to inject fluid near exhaust ports of the combustion chamber.

An engine cylinder head comprising a lower portion comprising an internal metallic structure, and an upper portion comprising an external polymer composite structure at least partially surrounding the internal metallic structure, wherein the internal metallic structure is integrally formed with a fluid injection arrangement comprising a plurality of internal fluid passages fluidly coupled to a plurality of injection ports arranged adjacent to exhaust ports of a combustion chamber. A first example of the engine cylinder head further includes where the external polymer composite structure is in face-sharing contact with the internal metallic structure. A second example of the engine cylinder head, optionally including the first example, further includes where the internal fluid passages are fluidly coupled to fluid passages of a portion of the fluid injection arrangement arranged outside of the internal metallic structure. A third example of the engine cylinder head, optionally including the first and/or second examples, further includes where the primary fluid passage is arranged adjacent to and outside of an exhaust side of the internal metallic structure. A fourth example of the engine cylinder head, optionally including one or more of the first through third examples, further includes where the plurality of injection ports is positioned to inject toward one or more of an exhaust port and a central spark plug and fuel injection area. A fifth example of the engine cylinder head, optionally including one or more of the first through fourth examples, further includes where the fluid injection arrangement does not extend into or contact the external polymer composite structure. A sixth example of the engine cylinder head, optionally including one or more of the first through fifth examples, further includes where the fluid injection arrangement comprising a primary fluid passage and a plurality of secondary fluid passages arranged outside of the internal metallic structure, wherein the primary fluid passage and the plurality of secondary fluid passages comprise tubes for directing fluid, and where internal surfaces of the internal metallic structure are shaped to guide fluid in the plurality of internal fluid passages. A seventh example of the engine cylinder head, optionally including one or more of the first through sixth examples, further includes where the fluid injection arrangement further comprises a plurality of valves shaped to adjust a flow of fluid through each of the secondary fluid passages.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

three-dimensionally printing an internal metallic structure with a fluid injection arrangement integrally formed therein; and molding an external polymer composite structure to at least partially surround the internal metallic structure comprising the fluid injection arrangement integrally formed therein.

2. The method of claim 1, wherein the internal metallic structure further comprises shaping one or more internal fluid passages fluidly coupling a primary water passage of an engine to a plurality of injection ports of the engine.

3. The method of claim 2, wherein the injection ports are arranged adjacent to one or more exhaust ports within a combustion chamber.

4. The method of claim 2, wherein the one or more internal fluid passages are separated from coolant and oil passages formed in the external polymer composite structure, and where fluid in the one or more internal fluid passages does not mix with fluids from the coolant and oil passages.

5. The method of claim 1, wherein the internal metallic structure is an upper portion of the combustion chamber, and where the internal metallic structure comprises a fire deck.

6. A system, comprising:

an engine comprising an internal metallic structure arranged on a combustion chamber side of an external polymer composite structure, wherein the external polymer composite structure is molded as a single-piece onto and at least partially surrounding the internal metallic structure, and wherein the internal metallic structure is a single-piece structure comprising a fluid injection arrangement integrally formed therein, wherein the fluid injection arrangement comprises a primary fluid passage and a plurality of valves arranged outside of the internal metallic structure, wherein a plurality of secondary fluid passages extends from the primary fluid passage outside of the internal metallic structure and fluidly couples to a plurality of internal fluid passages integrally formed in the internal metallic structure, and wherein each of the plurality of internal fluid passages integrally formed in the internal metallic structure includes a common passage that divides into multiple passages within the internal metallic structure to flow fluid to a plurality of injection ports.

7. The system of claim 6, wherein a number of the plurality of secondary fluid passages is equal to a number of the plurality of valves.

8. The system of claim 6, wherein the fluid injection arrangement is arranged on an exhaust side of the internal metallic structure.

9. The system of claim 6, wherein the fluid injection arrangement is shaped to inject fluid near exhaust ports of the combustion chamber.

10. An engine cylinder head, comprising:

a lower portion comprising an internal metallic structure; and an upper portion comprising an external polymer composite structure at least partially surrounding the internal metallic structure, wherein the internal metallic structure is integrally formed with a fluid injection arrangement comprising a plurality of internal fluid passages fluidly coupled to a plurality of injection ports arranged adjacent to exhaust ports of a combustion chamber, wherein at least one of the plurality of injection ports protrudes into the combustion chamber, wherein the fluid injection arrangement comprises a primary fluid passage and a plurality of valves arranged outside of the internal metallic structure, wherein a plurality of secondary fluid passages extends from the primary fluid passage outside of the internal metallic structure and fluidly couples to a plurality of internal fluid passages integrally formed in the internal metallic structure, and wherein each of the plurality of internal fluid passages integrally formed in the internal metallic structure includes a common passage that divides into multiple passages within the internal metallic structure to flow fluid to a plurality of injection ports.

11. The engine cylinder head of claim 10, wherein the external polymer composite structure is in face-sharing contact with the internal metallic structure.

12. The engine cylinder head of claim 10, wherein the internal fluid passages are fluidly coupled to the primary fluid passage and the plurality of secondary fluid passages forming a portion of the fluid injection arrangement arranged outside of the internal metallic structure.

13. The engine cylinder head of claim 12, wherein the primary fluid passage is arranged adjacent to and outside of an exhaust side of the internal metallic structure.

14. The engine cylinder of claim 10, wherein the plurality of injection ports is positioned to inject toward one or more of an exhaust port and a central spark plug and a fuel injection area.

15. The engine cylinder of claim 10, wherein the fluid injection arrangement does not extend into or contact the external polymer composite structure.

16. The engine cylinder of claim 10, wherein the primary fluid passage and the plurality of secondary fluid passages comprise tubes for directing fluid, and wherein internal surfaces of the internal metallic structure are shaped to guide fluid in the plurality of internal fluid passages.

17. The engine cylinder of claim 16, wherein the fluid injection arrangement further comprises a plurality of valves shaped to adjust a flow of fluid through each of the plurality of secondary fluid passages.

* * * * *